United States Patent [19]

Clark et al.

[11] Patent Number: 4,987,392

[45] Date of Patent: Jan. 22, 1991

[54] GALLIUM ARSENIDE ANTENNA SWITCH

[75] Inventors: Edward T. Clark, Plantation; Enrique Ferrer, Miami, both of Fla.

[73] Assignee: Motorola, Inc., Schaumburg, Ill.

[21] Appl. No.: 258,934

[22] Filed: Oct. 17, 1988

[51] Int. Cl.[5] ..... H01P 1/15

[52] U.S. Cl. ..... 333/103; 333/104; 333/33

[58] Field of Search ..... 333/103, 104, 262, 33; 455/78, 80

[56] References Cited

U.S. PATENT DOCUMENTS

| | | | |
|---|---|---|---|
| 3,965,445 | 6/1976 | Ou | 333/33 |
| 4,023,125 | 5/1977 | Wolfe | 333/262 X |
| 4,350,958 | 9/1982 | Pagnamenta | 333/33 X |
| 4,511,813 | 4/1985 | Pan | 333/104 X |
| 4,637,073 | 1/1987 | Selin et al. | 333/103 X |
| 4,789,846 | 12/1988 | Matsunaga et al. | 333/104 |

FOREIGN PATENT DOCUMENTS

| | | | |
|---|---|---|---|
| 1220031 | 3/1986 | U.S.S.R. | 333/104 |

OTHER PUBLICATIONS

Browne, "MMIC Switch Couples Inputs from DC to 6 GHz", Microwaves & RF, Dec. 1987, pp. 137–40.

*Primary Examiner*—Paul Gensler
*Attorney, Agent, or Firm*—Robert S. Babayi

[57] ABSTRACT

An electronic switch uses GaAs transistors to switch signals that have peak-to-peak voltage swings that exceed the breakdown voltage of the transistors. A two port impedance transformer (Z1) has a high input impedance and a low output impedance to transform a high voltage input signal (at T1) to a corresponding output signal having lower voltage, but higher current. This transformed signal is coupled to the second port of a three port impedance transformer (Z2) through a first GaAs transistor switch (Q1). A half wave rectifier circuit (D1, R7, R8 and C3) generates a negative DC voltage from the input signal (at T1), thereby eliminating the requirement for a separate bias voltage supply. A bipolar transistor switch selectively couples this negative bias voltage to the gate of the first GaAs transistor (Q1). The second port of the three port impedance transformer (Z2) has a lower impedance than either the first or third ports. A second GaAs transistor switch (Q2) is coupled between the third port of the three port impedance transformer (Z2) and ground, and a third GaAs transistor switch (Q3) couples the third port to a output terminal (T6) of the switch. The first port of the three port impedance transformer (Z2) is coupled to an input/output terminal (T2) of the switch.

14 Claims, 1 Drawing Sheet

GALLIUM ARSENIDE ANTENNA SWITCH

BACKGROUND OF THE INVENTION

This invention pertains to electronic switches and, more particularly, to a Gallium Arsenide (GaAs) field effect transistor switch suitable for switching radio frequency signals.

GaAs transistors have been used in electronic switches and are sometimes preferred over PIN diodes because these transistors can be integrated on a monolithic integrated circuit chip and because they dissipate negligible power in the ON state. GaAs transistors are usually preferred over other field effect transistors because of their high frequency operating characteristics.

GaAs transistors, however, have several disadvantages. First, GaAs field effect transistors are depletion mode devices which require a negative bias voltage (for an N-channel device) between the gate and source terminals to switch the transistor to the OFF state. This requires an additional power supply to operate the switch. Second, currently available GaAs transistors have a drain to source breakdown voltage of approximately 18 Volts. Exceeding this breakdown voltage causes irreversible damage. Consequently, GaAs transistors can only be used to switch signals up to approximately three (3) Watts, assuming a fifty (50) Ohm load.

The GaAs switch described below, however, not only permits the switching of higher power signals, but also eliminates the need for an additinal bias voltage supply by deriving the necessary bias voltage directly from the input signal to the switch.

SUMMARY OF THE INVENTION

Briefly, the invention is a switch that includes a first transforming means for transforming impedance. The first transforming means has first and second ports, the impedance of the second port being lower than the impedance of the first port. A second transforming means for transforming impedance includes first, second and third ports, the impedance of the second port being lower than the impedance of either the first or third ports. Also included is a first switching means for coupling the second port of the first transforming means to the second port of the second transforming means when the first switching means switched ON.

In another embodiment, the invention includes the first and second transforming means described above, plus a Gallium Arsenide transistor coupled between the second port of the first transforming means and the second port of the second transforming means.

DESCRIPTION OF THE PREFERRED EMBODIMENT

Figure 1:
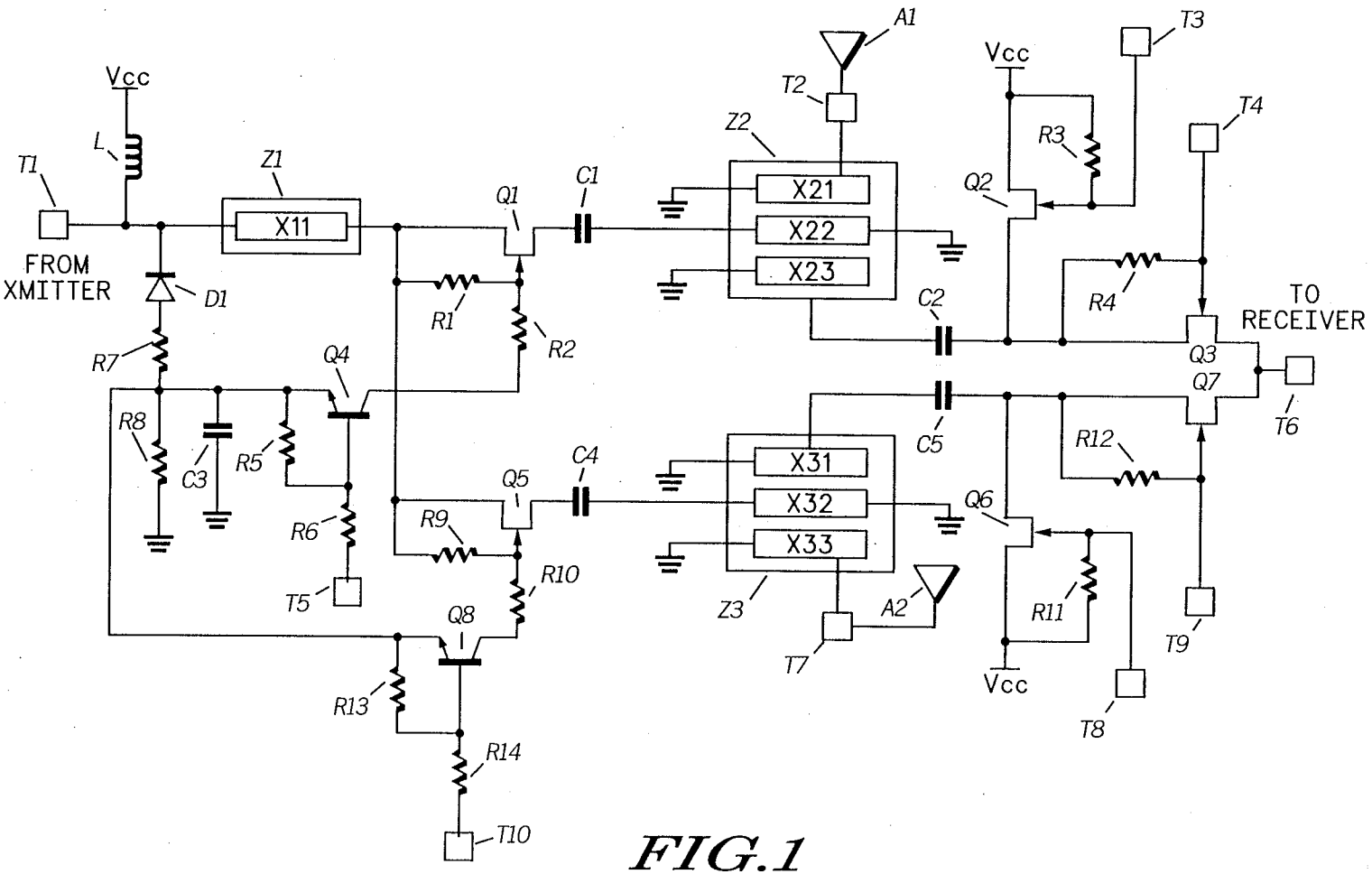
FIG. 1 is a schematic diagram of the preferred embodiment of the present invention.

Referring to FIG. 1, impedance transformer Z1 has input and output ports (the input port is connected to terminal T1). The impedance of the imput port should be higher than the impedance of the ouput port. In an exemplary embodiment of the invention, for example, the impedance of the input port is 50 Ohms, while the impedance of the output port is 6.25 Ohms. In general, the impedance of the input port is selected to match the output impedance of the driving device connected to terminal T1. In the embodiment illustrated in FIG. 1, the driving device is the R.F. power amplifier stage of a non-illustrated radio transmitter. The ratio of the input to output port impedances is selected so that the voltage at the input port is sufficiently reduced at the output port such that the breakdown voltage of the switching circuit that follows is not exceeded. Although the voltage is reduced, the current at the output port will be proportionally increased, such that the input and output power is substantially identical, less some small insertion loss.

Impedance transformer Z1 is preferably a ¼ wavelength transmission line device, such as a well known strip-line or micro-strip device. To set the input and output impedances, the physical parameters of the transmission line device, such as the width of transmission line conductor X11 or the height and dielectric constant of the substrate, may be selected according to well known design rules. Although a transmission line device is preferred at higher frequencies, other well known devices for transforming impedance may be suitable, such as a well known lumped element impedance transformation circuit.

Transistor Q1 and bias resistors R1 and R2 form a first electronic switch. Transistors Q1–Q3, as well as transistors Q5–Q7, described below, are preferably Gallium Arsenide (GaAs) field effect transistors. Other well known devices may also be suitable, such as bipolar transistors, field effect transistors constructed from a technology other than GaAs, or even mechanical relays. Inductor L is a choke that provides DC bias voltage to the source of transistor Q1 (and to the source of transistor Q2, described below). The value of inductor L is selected to provide a large impedance at the operating frequency.

A second impedance transformer Z2 has first, second and third ports, the first port being coupled to antenna A1 and the second port being coupled to transistor Q1 through capacitor C1. The values of capacitors C1 and C2, as well as the values of capacitors C4 and C5, are selected to provide a substantial short at the operating frequency. The impedance at the second port (the port connected to transmission line X22) should be lower than the impedances of the first or third ports (the ports connected to transmission lines X21 and X23, respectively) and, ideally, the impedance at the second port should match the impedance of the output of transformer Z1. In an exemplary embodiment of the invention, the impedance at the first and second ports is 50 Ohms, while the impedance at the second port is 6.25 Ohms.

transformer Z2 is preferably as well known interdigitated transmission line device, such as a stip-line or micro-strip device. In the interdigitated transmission line device, the three transmission lines X21, X22, and X23 are mutually electromagnetically coupled. To set the impedances of the three ports of transformer Z2, the physical parameters of the transmission line device may be selected according to well known design rules, such as by selecting different widths for each of the transmission lines, by selecting a particular height and dielectric constant for the substrate, and by selecting a particular spacing of the various transmission lines. As with transformer Z1, transformer Z2 may also be any well known impedance transforming device, such as a lumped element impedance transforming circuit.

Transistor Q2 and bias resistor R3 form a second electronic switch, while transistor Q3 and bias resistor R4 form a third. The source terminal of transistor Q2 is connected to power supply terminal $V_{cc}$. It is presumed, however, that an AC short exists between power supply terminal $V_{cc}$ and ground. Thus, the source terminal of transistor Q2 is effectively coupled to ground. The drain of transistor Q2 and the source terminal of transistor Q3 are coupled to the third port of transformer Z2 through capacitor C2. The drain terminal of transistor Q3 is connected to terminal T6. It should be noted that FIG. 1 assumes that the field effect transistors are bidirectional devices, such that it is entirely arbitrary as to which end of the channel is referred to as the source and which end the drain.

Diode D1, resistors R7 and R8, and capacitor C3 form a half wave rectifier and filter circuit that converts the input signal at terminal T1 to a negative DC voltage at the emitter of transistor Q4. More particularly, resistors R7 and R8 form a voltage divider circuit that reduces the voltage at the anode of diode D1. The values of resistors R7 and R8 depend upon the maximum voltage at input terminal T1, and are selected such that the voltage at the gate of transistor Q1 is sufficient to pinch off the transistor, but does not exceed the gate to source breakdown voltage of the transistor. Capacitor C3 is a filter capacitor and its value will depend upon the intended operating frequency of the invention. Diode D1 is preferably a Schottky diode, although other diodes may also be suitable. Although a half wave rectifier circuit is illustrated, other well known AC-DC converter circuits may also be employed, such as a full wave rectifier circuit or voltage multiplier circuit.

Although a four port switch is illustrated in FIG. 1, the invention may be practiced as a three port switch utilizing the elements described above. To construct a four port switch, transistors Q5–Q7, resistors R9–R14, capacitors C4–C5 and impedance transformed Z3 are added to the circuit as illustrated in FIG. 1. These additional elements are substantially identical to, and function in the same manner as transistors Q1–Q3, resistors R1–R6, capacitors C1–C2 and impedance transformer Z1, respectively.

The preferred applicaiton of the invention is as an antenna switch for a radio transceiver, although the invention may be used to switch any AC signal. FIG. 1 illustrates the preferred application wherein terminal T1 is connected to the output of an R.F. power amplifier stage of a radio transmitter, terminal T6 is connected to the R.F. input of a radio receiver, and terminals T2 and T7 are respectively connected to antennas A1 and A2.

OPERATION

To switch the depletion mode field effect transistors Q1–Q3 and Q5–Q7 OFF, a negative gate to source voltage is required. The preferred embodiments of the invention assumes that the peak-to-peak input voltage swing at terminal T1 is sufficiently large such that, simply bringing the gate voltage of transistor Q1 or Q5 to ground potential is insufficient to shut the transistor OFF throughout the entire cycle of the input signal. (The source voltage of transistors Q1 and Q5 is pulled to $V_{cc}$, a positive voltage, through inductor L. Thus, simply grounding the gate results in a negative gate to source voltage.) Consequently, the rectifier circuit (diode D1, resistors R7 and R8, and capacitor C3) provides a sufficient negative voltage to turn transistors Q1 and Q5 OFF. This negative voltage is coupled to the gate of transistor Q1 when transistor Q4 is switched ON, and to the gate of transistor Q5 when transistor Q8 is ON.

To switch transistor Q4 ON, terminal T5 is grounded, thereby causing current to flow through the base-emitter junction of transistor Q4. Connecting T5 to $V_{cc}$ will also turn transistor Q4 ON. To switch transistor Q4 OFF, terminal T5 is open circuited. Similarly, transistor Q8 is switched ON by grounding terminal T10, and OFF by open circuiting terminal T10. Accordingly, transistor Q1 is switched ON when terminal T5 is open circuited, and OFF when terminal T5 is grounded. Similarly, Transistor Q5 is switched ON when terminal T10 is open circuited, and OFF when terminal T10 is grounded.

To switch transistors Q2, Q3, Q6 and Q7 ON, $V_{cc}$ is applied to the gate of each transistor through terminals T3, T4, T8 and T9, respectively. Grounding the gate of one of these transistors switches the transistor OFF.

To transmit using antenna A1, transistors Q1, Q2, and Q6 are switched ON, while transistors Q3, Q5 and Q7 are switched OFF. The signal at terminal T1 is transformed by impedance transformer Z1 into a corresponding signal that has a lower voltage and higher current. This transformed signal is coupled to the second port of impedance transformer Z2 through transistor Q1 and capacitor C1. The signal at the second port of transformer Z2 is decoupled from the second port of transformer Z3, because transistor Q5 is switched OFF. Since Q2 is switched ON and transistor Q3 is switched OFF, the third port of transformer Z2 is not only shorted to ground through transistor Q2 (we assume that $V_{cc}$ is an AC ground), but also decoupled from terminal T6. The signal at the second port of transformer Z2 is then coupled to the first port through transmission lines X22 and X21. In the process, an impedance transformation takes place such that the signal at temrinal T2 has a higher voltage and lower current than the signal present at the second port of impedance transformer Z2. Usually, transformers Z1 and Z2 perform equal, but opposite impedance transformations such that, ideally, the signal at terminal T2 is identical to the signal at terminal T1. To transmit using antenna A2, transistors Q2, Q5 and Q6 are switched ON, while transistors Q1, Q3, and Q7 are switched OFF.

To receive using antenna A1, transistors Q3 and Q6 are switched ON, while transistors Q1, Q2, Q5 and Q7 are switched OFF. A signal picked up by antenna A1 is coupled through transmission lines X21, X22 and X23 of impedance transformer Z2, and through capacitor C2 and transistor Q3 to terminal T6. Usually, the impedances at the first (terminal T2) and third (at capacitor C2) ports of impedance transformer Z2 are identical, such that no net impedance transformation occurs in the receive mode. this is not required, however, as the parameters of impedance transformer Z2 can be adjusted to provide for an impedance transformation in the receive path. To receive using antenna A2, transistors Q7 and Q2 are switched ON, while transistors Q1, Q3, Q5 and Q6 are switched OFF.

In addition to the impedance transformation, impedance transformer Z2 also provides two poles of filtering in the transmit path (T1 to either T2 or T7), while three poles are provided in the receive path (either T2 or T7 to T6).

We claim as our invention:

1. A switch, comprising in combination:

first transforming means for transforming impedance, said first transforming means having first and second ports, the impedance of said second port of said first transforming means being lower than the impedance of said first port of said first transforming means;

second transforming means for transforming impedance, said second transforming means having first, second and third ports, the impedance of said second port of said second transforming means being lower than the impedance of said first and third ports of said second transforming means;

first switching means for coupling said second port of said first transforming means to said second port of said second transforming means when said first switching means is switched ON;

converter means for converting signal at said first port of said first transforming means to a DC voltage; and second switching means for coupling said converter means to said first switching means, when said second switching means is switched ON.

2. The switch of claim 1, wherein said second transforming means includes mutually electromagnetically coupled first, second and third transmission lines respectively coupled to said first, second and third ports of said second transforming means.

3. The switch of claim 1, further comprising:

third switching means for shorting said third port of said second transforming means when said third switching means is switched ON; and fourth switching means for coupling said third port of said second transforming means to a terminal of said switch when said fourth switching means is switched ON.

4. The switch of claim 3, wherein said second transforming means includes mutually electromagnetically coupled first, second and third transmission lines respectively coupled to said first, second and third ports of said second transforming means.

5. A switch, comprising in combination:

first transforming means for transforming impedance, said first transforming means having first and second ports, the impedance of said second port of said first transforming means being lower than the impedance of said first port of said first transforming means;

second transforming means for transforming impedance, said second transforming means having first, second and third ports, the impedance of said second port of said second transforming means being lower than the impedance of said first and third ports of said second transforming means;

first switching means for coupling said second port of said first transforming means to said second port of said second transforming means when said first switching means is switched ON;

second switching means for shorting said third port of said second transforming means when said second switching means is switched ON; and third switching means for coupling said third port of said second transfroming means to a terminal of said switch when said third switching means is switched ON.

6. The switch of claim 5, wherein said second transforming means includes mutually electromagnetically coupled first, second and third transmission lines respectively coupled to said first, second and third ports of said second transforming means.

7. A switch, comprising in combination:

first transforming means for transforming impedance, said first transforming means having first and second ports, the impedance of said second port of said first transforming means being lower than the impedance of said first port of said first transforming means;

second transforming means for transforming impedance, said second transforming means having first, second and third ports, the impendanc of said second port of said second transforming means being lower than the impedance of said first and third ports of said second transforming means;

first switching means for coupling said second port of said first transforming means to said second port of said second transforming means when said first switching means is switched ON; wherein said second transforming means includes mutually electromagnetically coupled first, second and third transmission lines respectively coupled to said first, second and thrid ports of said second transforming means.

8. A switch, comprising in combination:

first transforming means for transforming impedance, said first transforming means having said second ports, the impedance of said second port of said first transforming means being lower than the impedance of said first port of said first transforming means;

second transforming means for transforming impedance, said second transforming means having first, second and third ports, the impedance of said second port of said second transforming means being lower than the impedances of said first and third ports of said second transforming means;

a first Gillium Arsenide transistor coupled between said second port of said first transforming means and said second port of said second transforming means;

converter means for converting a signal at said first port of said first transforming means to a DC voltage; and switching means for coupling said converter means to said first Guillium Arsenide transistor, when said second switching means is switched ON.

9. The switch of claim 8, wherein said second transforming means includes a transmission line device having first, second and third one-quarter wavelength transmission lines respectively coupled to said first, second and third ports of said second transforming means.

10. The switch of claim 8, further comprising:

a second Gallium Arsenide transistor coupled between said third port of said second transforming means and a power supply terminal; and a thrid Gallium Arsenide transistor coupled between said third port of said second transforming means and a terminal of said switch.

11. The switch of claim 10, wherein said second transforming means includes a transmission line device having first, second and third one-quarter wavelength transmission lines respectively coupled to said first, second and third ports of said second transforming means.

12. A switch, comprising in combination:

first transforming means for transforming impedance, said first transforming means having first and second ports, the impedance of said second port of said first transforming means being lower than the impedance of said first port of said first transforming means;

second transforming means for transforming impedance, said second transforming means having first, second and third ports, the impedance of said second port of said second transforming means being lower than the impedances of said first and third ports of said second transforming means;

a first Gallim Arsenide transistor coupled between said second port of said first transforming means and said second port of said second transforming means;

a second Gallium Arsenide transistor coupled between said third port of said second transforming means and a power supply terminal; and a third Gallium Arsenide transistor coupled between said third port of said second transforming means and a terminal of said switch.

13. The switch of claim 12, wherein said second transforming means includes a transmission line device having first, second and third one-quarter wavelength transmission lines repectively coupled to said first, second and third ports of said second transforming means.

14. A switch, comprising in combination:

first transforming means for transformimg impedance, said first transforming means having first and second ports, the impedance of said second port of said first transforming means being lower than the impedance of said first port of said first transforming means;

second transforming means for transforming impedance, said second transforming means having first, second and third ports, the impedance of said second port of said second transforming means being lower than the impedances of said first and third ports of said second transforming means;

a first Gallium Arsenide transistor coupled between said second port of said first transforming means and said second port of said second transforming means; wherein said second transforming means includes a transmission line device having first, second and third one-quarter wavelength transmission lines respectively coupled to said first, second and third port of said second transforming means.

* * * * *

UNITED STATES PATENT AND TRADEMARK OFFICE

CERTIFICATE OF CORRECTION

PATENT NO. : 4,987,392

DATED : January 22, 1991

INVENTOR(S) : Clark, et al

It is certified that error appears in the above-identified patent and that said Letters Patent is hereby corrected as shown below:

Column 6
Claim 7, line 20, delete "thrid" and insert therefor

-- third --.

Column 6
Claim 8, line 24, delete "said" and before "second"

insert -- first and --.

Column 6
Claim 10, line 55, delete "thrid" and insert therefor

-- third --.

Column 8
Claim 14, line 23, delete "port" and insert therefor

-- ports --.

Signed and Sealed this

Eleventh Day of August, 1992

*Attest:*

*Attesting Officer*

DOUGLAS B. COMER

*Acting Commissioner of Patents and Trademarks*